US005649373A

United States Patent [19]

Winter et al.

[11] Patent Number: 5,649,373

[45] Date of Patent: Jul. 22, 1997

[54] SHOE STRUCTURE

[75] Inventors: David A. Winter, Waterloo; Paula A. Dozzi, Sudbury, both of Canada

[73] Assignee: University of Waterloo, Waterloo, Canada

[21] Appl. No.: 472,271

[22] Filed: Jun. 7, 1995

Related U.S. Application Data

[63] Continuation-in-part of Ser. No. 144,157, Sep. 28, 1993, abandoned, which is a continuation of Ser. No. 812,005, Dec. 23, 1991, abandoned.

[30] Foreign Application Priority Data

Dec. 21, 1990 [GB] United Kingdom ..... 9027928

[51] Int. Cl.[6] ..... A43B 5/12

[52] U.S. Cl. ..... 36/8.3; 36/28

[58] Field of Search ..... 36/8.3, 113, 96, 36/7.8, 27, 28

[56] References Cited

U.S. PATENT DOCUMENTS

| | | | |
|---|---|---|---|
| 298,844 | 5/1884 | Glanville | 36/28 |
| 891,090 | 6/1908 | Mitchell | 36/27 |
| 1,088,328 | 2/1914 | Cucinotta | 36/28 |
| 1,144,188 | 6/1915 | Gerlach | 36/28 |
| 1,502,087 | 7/1924 | Bunns | 36/28 |
| 5,343,837 | 9/1994 | Schindler | 36/7.8 |

FOREIGN PATENT DOCUMENTS

| | | | |
|---|---|---|---|
| 23214 | 3/1900 | United Kingdom | 36/7.8 |

*Primary Examiner*—Ted Kavanaugh

*Attorney, Agent, or Firm*—Sim & McBurney

[57] ABSTRACT

A novel shoe structure, particularly a ballet shoe, is provided in which an elongate flat leaf spring element is provided associated with the sole of the shoe structure. The elongate leaf spring extends from the toe region of the shoe structure beyond the location of the metatarsal-phalangeal (m-p) joints of the wearer, so as to provide a mechanical power assist to the wearer at the m-p joints.

2 Claims, 4 Drawing Sheets

SHOE STRUCTURE

REFERENCE TO RELATED APPLICATION

This application is a continuation-in-part of U.S. patent application Ser. No. 08/144,157 filed Sep. 28, 1993 now abandoned, which itself is a continuation of U.S. patent application Ser. No. 07/812,005 filed Dec. 23, 1991 (now abandoned).

FIELD OF INVENTION

The present invention relates to a modified form of shoe, particularly ballet, walking and running shoes.

BACKGROUND TO THE INVENTION

Almost half the injuries in ballet are to the foot and occur when ballerinas dance on the tip of their toes, that is a "full-pointe". Fatigue of muscles crossing the metatarsal-phalangeal (m-p) joints is thought to be a causal factor. Tendonitis of flexor hallucis longus, acute intrinsic muscle spasm and repetitive muscle strain injuries at midtarsal are common in ballerinas and occur when manoeuvring to the full-pointe position. Fatigue is also thought to be a major factor in fractures to the phalanges, metatarsals and sesamoid bones as acute fractures usually occur towards the end of a day when the feet of the dancer are very tired.

The pointe shoes themselves do offer some support but quickly breakdown and lose their beneficial characteristics, often ready to be discarded after one performance. Ballet shoes have not kept pace with the technical demands of ballet choreography. The relative contribution of the ankle plantarflexor muscles and m-p flexor group to the energetics of rising onto full-pointe is approximately 60% for the ankle joint and 40% for the m-p joints. The relatively small m-p muscles, therefore, must generate almost half the total energy required.

SUMMARY OF THE INVENTION

In accordance with the present invention, a shoe is provided in which an elongate flat leaf spring is provided associated with the sole and extending from the toe region towards the heel region and beyond the m-p joints of a wearer of the shoe structure, with the midpoint of the length of the elongate spring preferably being located approximately below the m-p joints. The presence of this leaf spring, in the shoe structure provides a mechanical power assist at the m-p joints of a wearer of the shoe structure.

DESCRIPTION OF PREFERRED EMBODIMENT

Figure 1:
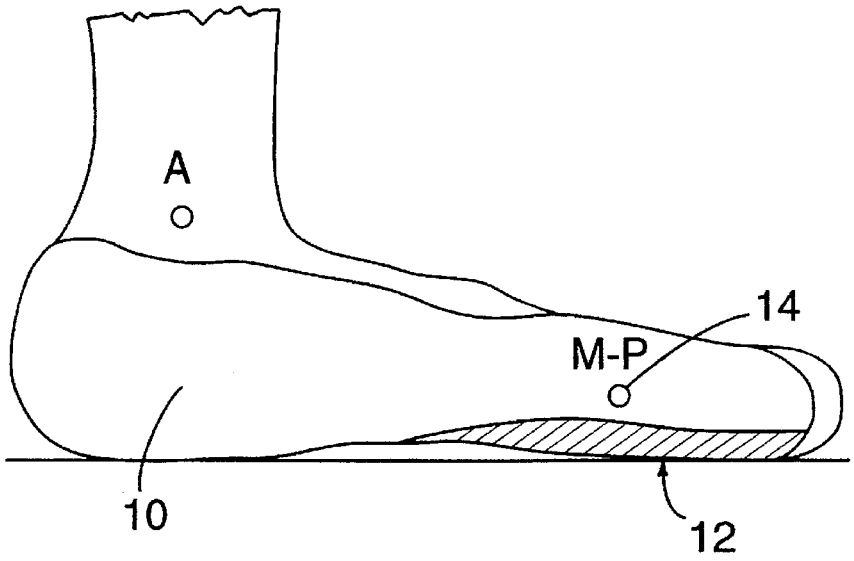
FIG. 1 shows a ballet shoe modified in accordance with one embodiment of the invention, showing the leaf spring in a neutral position.

Referring to the drawings, a ballet shoe 10 of conventional construction is modified by locating an elongate leaf spring 12 inside the shoe extending from the toe region to the arch or instep of a wearer and hence under the m-p joints 14 of the wearer. When the foot is flat, as in FIG. 1, the leaf spring 12 is in a neutral position. In the illustrated embodiment, the mid-point of the length of the spring is located below the m-p joints of the wearer.

Figure 6:
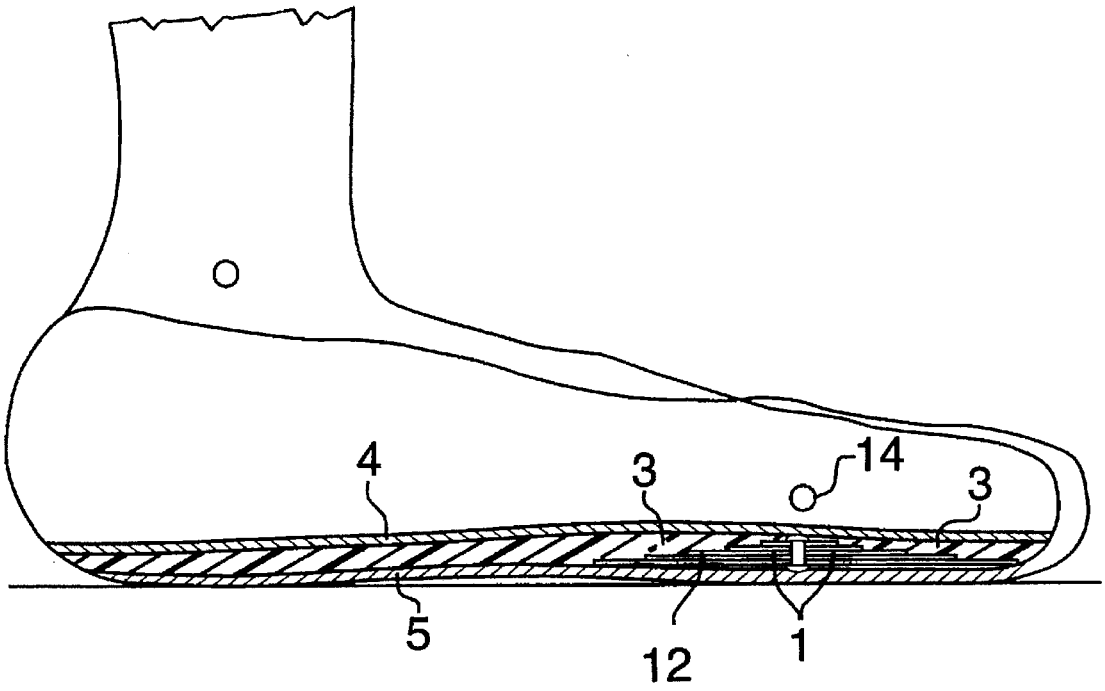
FIG. 6 is a detailed view of the construction and location of the leaf spring.

A more detailed illustration of the leaf spring is shown in FIG. 6. The thickness and scale of the leaf spring are exaggerated for clarification of the construction. As seen therein, the leaf spring 12 has a plurality of superimposed leaf elements 1 which are rivetted together at the centre by rivet 2, located below the metatarsal-phalangeal (m-p) joints. The superimposed leaf elements 1 includes elements of increasingly shorter longitudinal dimension, so the leaf spring is stiffer where there are the greatest number of superimposed spring layers, i.e., in the middle region of the leaf spring, and the leaf spring is most flexible where there are the fewest number of superimposed spring layers, i.e. adjacent to the longitudinal extremities of the spring, with the stiffness of the spring becoming more flexible in stages as there are less overlapping spring layers while moving from the middle region toward the longitudinal extremities.

The leaf spring 12 is located with a cavity defined by an upper leather and cloth liner 4 of the inside of the slipper extending from the heel to the toe and a lower leather and satin layer 5 extending from heel to toe. The cavity is filled with a composition molded plastic material 3.

Figure 2:
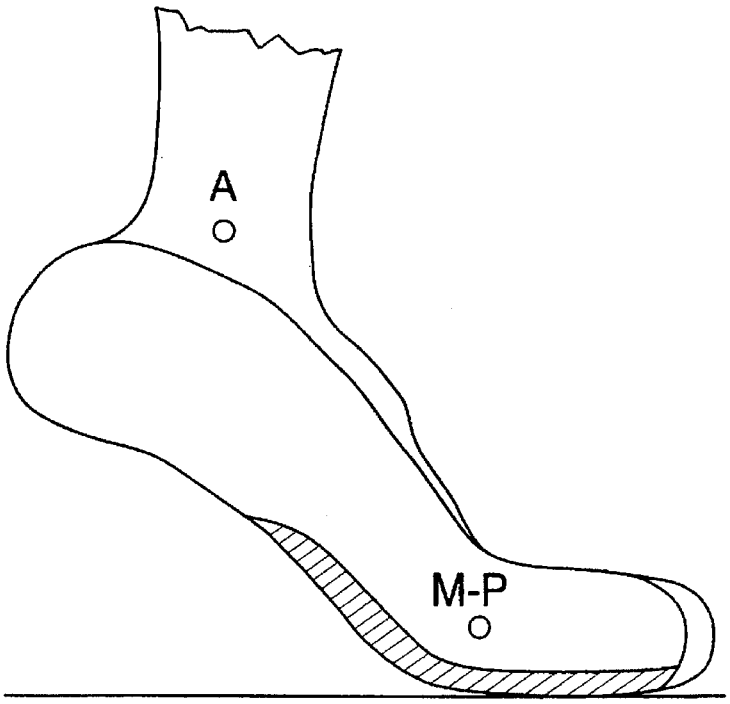
FIGS. 2 to 4 show the effect of raising the foot of a wearer of the ballet shoe of FIG. 1 to the full-pointe position.

As the ankle plantarflexors lift the heel off the floor in an intermediate position, the leaf spring 12 is deflected and maximum energy storage in the leaf spring 12 occurs, as seen in FIG. 2. This energy is derived from the large plantarflexor muscles.

Figure 3:
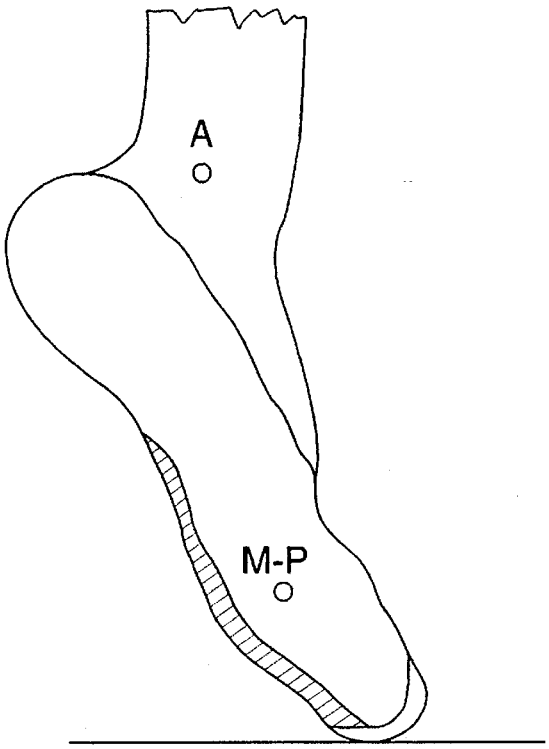

The energy which is stored in the leaf spring 12 as a result of this action then is recovered as the phalangeal segment rises from the ball of the foot to the tips of the toes, as seen in FIG. 3. The recovery of the energy from the leaf spring 12 during this movement provides a mechanical power assist which helps the smaller muscles flex the m-p joints.

Figure 4:
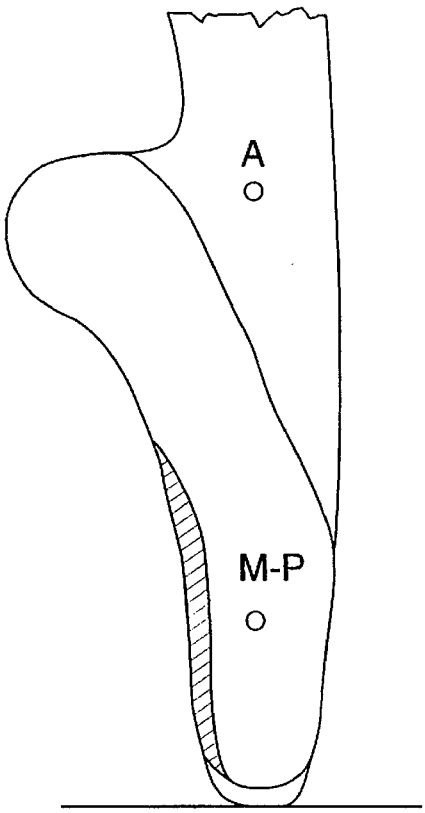

When the dancer reaches the full-pointe position on the tip of the toes, the deflection of the leaf spring 12 is reversed slightly which assists in maintaining stability at the m-p joints, as seen in FIG. 4. The use of a leaf spring 12 having superimposed spring elements which provide a minimum stiffness in the middle region thereof varying in thickness to a maximum stiffness adjacent the longitudinal ends, enables these movements to be achieved with the assistance of the spring. This action is not provided by a single spring element.

The leaf spring 12 may be associated with the sole of the shoe 10 in any convenient manner, such as by physical attachment or by incorporating the leaf spring 12 into the material of construction of the sole. Alternatively, the leaf spring 12 may be part of a separate element inserted into the shoe 10 to abut the sole of the shoe, for example, a thin pressboard insert which is molded to accept the spring 12.

The leaf spring 12 may be constructed of any convenient energy storing material, such as spring steel, which is able to repetitively provide the required flexure in use and to provide the main weight-bearing structure of the sole of the shoe.

The leaf spring 12, therefore, provides a mechanical assist at the m-p joints which decreases the occurrence of fatigue and the related injuries described above. Since the leaf spring 12 is not subject to deformation under its loading conditions and provides the main weight-bearing structure of the sole of the shoe, the sole of the shoe is more durable and this leads to a decrease in the breakdown of the shoe.

Figure 5A:
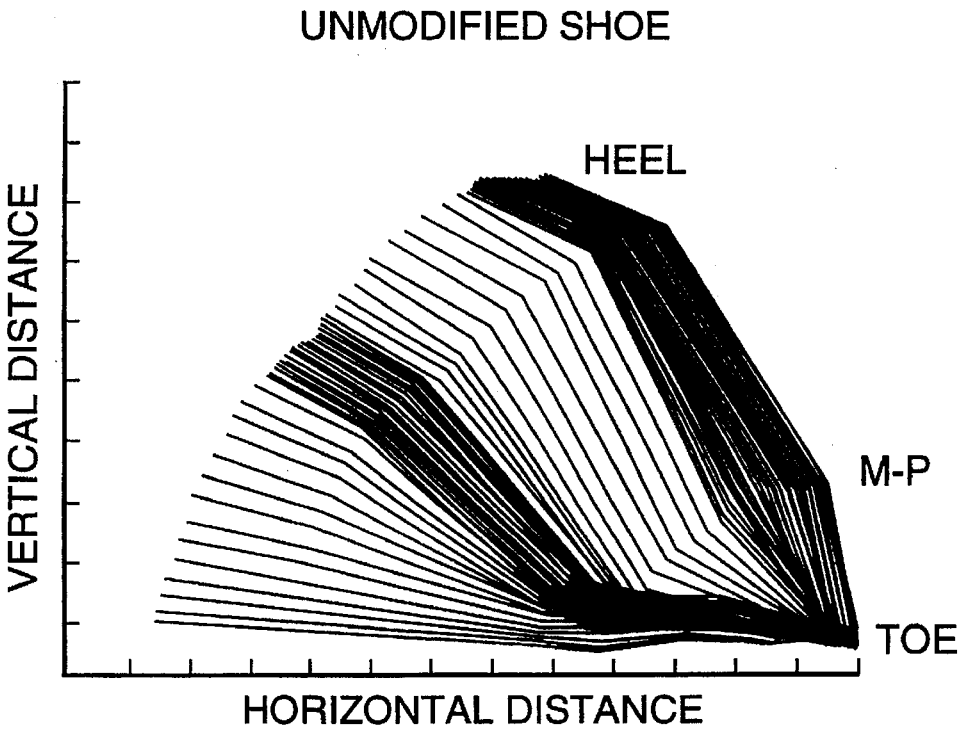
FIG. 5 contains graphical representations of the rising action of a ballet dancer from rest to full-pointe position, both for the ballet shoe of FIG. 1 and an unmodified ballet shoe.
Figure 5B:
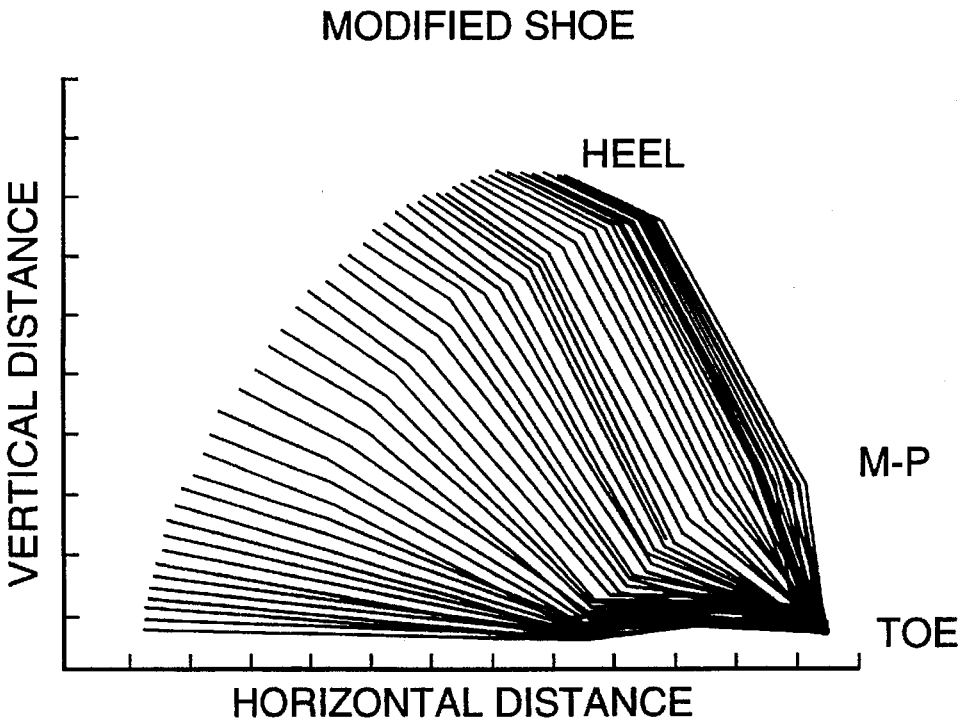

In addition to the advantages noted above for the modified ballet shoe, it has also been found that the rising action of the foot from rest to full-pointe is smoother than for a conventional ballet shoe, as seen in FIG. 5. Accordingly, the aesthetics of the pointe movement is increased.

In addition to the particular benefits modification to the ballet shoes produce, advantages also can be gained by effecting similar modifications to normal walking and running shoes. In normal walking and running shoes, as the heel lifts off the ground and rotates forward, the m-p joints extend and absorb energy, which is lost as heat.

By modifying the sole of such shoe structures to provide a leaf spring extending from the toe region across the m-p joint to the arch or instep of the foot, the spring stores energy as the m-p joints extend and returns this energy immediately before the toe-off or the fore part of the sole flexes back to its neutral position. Thus, some of the energy that is normally dissipated in the m-p muscles in the push-off phase of gait is now stored and recovered during the last phase of push-off.

Accordingly, a more vigorous push-off is achieved for the same metabolic energy cost, enabling a person wearing the shoes to walk or run faster. In addition, if the person wishes to walk or run at the same speed, the metabolic energy cost correspondingly is decreased.

SUMMARY OF DISCLOSURE

In summary of this disclosure, the present invention provides a novel shoe structure which provides considerable benefits to a person wearing the same. Modifications are possible within the scope of this invention.

What we claim is:

1. A shoe structure in the form of a ballet slipper comprising:

an upper having a toe and an elongate sole having a toe region, an instep region and a heel region, and an elongate planar resiliently-flexible leaf spring element associated with said sole and extending from said toe region towards said heel region beyond the location of the metatarsal-phalangeal joints of a ballerina wearer of the ballet slipper to said instep region and sufficiently that the metatarsal-phalangeal joints of a wearer are located at substantially the mid-point of the length of the leaf spring, said-elongate planar leaf spring comprising a plurality of elongate superimposed leaf spring elements which are of decreasing longitudinal length and symmetrically arranged with respect to the next-adjacent elements to provide a maximum stiffness of the leaf spring at a central region of the leaf spring, a minimum stiffness of the leaf spring adjacent longitudinal extremities of the leaf spring and graduated decreases in stiffness intermediate the central region and the longitudinal extremities of the leaf spring, said elongate planar leaf spring element being constructed and arranged to permit:

(a) a ballerina wearing said ballet slipper to flex said planar elongate leaf spring element to a convex position as the ballerina raises the heel and instep region of the sole of the ballet slipper with the toe region in contact with a surface on which the wearer is standing, by rotation of a foot of the ballerina about the metatarsal phalangeal joints, thereby to store energy in said planar elongate leaf spring element, (b) a ballerina wearing said ballet slipper to raise the toe region of said sole of the ballet slipper progressively off said surface as the ballerina moves towards a pointe position while the planar elongate leaf spring element flexes away from said convex position towards a planar position while releasing said stored energy to assist the ballerina to pass towards the pointe position standing on the toe of said upper, and (c) a ballerina wearing said ballet slipper to assume the pointe position standing on the toe of the upper while the planar elongate leaf spring element flexes to a concave position to stabilize the metatarsal-phalangeal joint of the ballerina while standing in the pointe position.

2. The shoe structure of claim 1 wherein said leaf spring element is associated with said sole by incorporating the same into the sole structure.

* * * * *